US007549253B2

(12) United States Patent
Hockman

(10) Patent No.: US 7,549,253 B2
(45) Date of Patent: Jun. 23, 2009

(54) NON PENETRATING SYSTEM FOR MOUNTING ON RAISED SEAMS

(76) Inventor: Mark Hockman, c/o Snow Master, P.O. Box 586, Westtown, PA (US) 19395

( * ) Notice: Subject to any disclaimer, the term of this patent is extended or adjusted under 35 U.S.C. 154(b) by 464 days.

(21) Appl. No.: 11/487,588

(22) Filed: Jul. 17, 2006

(65) Prior Publication Data

US 2007/0051053 A1 Mar. 8, 2007

Related U.S. Application Data

(60) Provisional application No. 60/700,344, filed on Jul. 19, 2005.

(51) Int. Cl.
*E04D 13/10* (2006.01)

(52) U.S. Cl. ..... 52/25; 52/24

(58) Field of Classification Search ..... 52/24, 52/25, 26, 41, 42, 44; 182/45; 248/148, 248/237

See application file for complete search history.

(56) References Cited

U.S. PATENT DOCUMENTS 1,054,091 A * 2/1913 Darnall ..... 248/237
5,609,326 A * 3/1997 Stearns et al. ..... 256/12.5
6,357,184 B1 * 3/2002 Alley ..... 52/25
6,453,623 B1 * 9/2002 Nelson et al. ..... 52/24
6,718,718 B2 * 4/2004 Haddock ..... 52/545
6,834,466 B2 * 12/2004 Trevorrow et al. ..... 52/24

* cited by examiner

*Primary Examiner*—Robert J Canfield
*Assistant Examiner*—Christine T Cajilig
(74) *Attorney, Agent, or Firm*—William E. Jackson; Stites & Harbison PLLC

(57) ABSTRACT

A mounting and attachment system, which can easily mount a continuous snow rail for snow protection above the seams of a metal root and also attach lower members or snow flags which are located between the seams to stop the snow from sliding under the height of the seam. This system eliminates the requirement for holes and threaded holes to be drilled into the mounting block, saving manufacturing time and money. The mounting block is configured so that there is a slot which runs through the mounting block to fit over a raised seam. This slot can have parallel walls or can be shaped to match the form of a particular seam. This block will also have two slots or linear indentations on either side of the block in a direction perpendicular to the slot for the seam. A second piece of the assembly is a snow rail long enough to connect two or more of the seam-mounted blocks together.

13 Claims, 4 Drawing Sheets

NON PENETRATING SYSTEM FOR MOUNTING ON RAISED SEAMS

REFERENCE TO PRIOR APPLICATION

This application claims the benefit of the filing date of applicant's Provisional Patent Application No. 60/700,344, filed Jul. 19, 2005.

BACKGROUND OF THE INVENTION

The invention relates to a non-penetrating system for mounting other devices (e.g. accessories) and snow brake systems for metal roofs with raised metal seams.

Mounting attachments and snow protection systems to metal roofs have always created problems for either the method of attachment or by the function of the finished application. The following system overcomes many problems and can be installed in an endless variety of configurations.

The present invention provides a method of attaching specially shaped mounting blocks to a raised metal seam without penetrating said seam while providing an adaptable shape for a number of different functions.

The present invention uses an improved mounting and attachment system, which can easily be mounted. The present invention uses an improved mounting and attachment system, which can easily mount continuous snow rail for snow protection above the seam and also attach lower members or snow flags which fall between the seams to stop the snow from sliding under the height of the seam. This system eliminates the requirement for holes and threaded holes to be drilled into the mounting block, saving manufacturing time and money. The mounting block is configured so that there is a slot which runs through the mounting block to fit over a raised seam. This slot can have parallel walls or can be shaped to match the form of a particular seam. This block will also have two slots or linear indentations on either side of the block in a direction perpendicular to the slot for the seam. These slots or indentations can be of any shape and not limited to the design as shown in the drawings as long as they run the length of the block. A second piece of the assembly is a rail long enough to connect two or more of the seam-mounted blocks together. The bottom of the second piece has a groove on either side which will match the groove in the mounting block, thus being of a design to slide onto the mounting block and, at the same time, align the blocks and attach to the mounting blocks without fasteners. The shape of the top rail can have a raised portion that will act as a snow rail or snow bar. This system eliminates bolts and holes generally associated with the assembly of this type of system. Another aspect of the invention utilizes the slot that mounts the rail to the mounting blocks for mounting snow protection sections (e.g., snow flags) between the raised metal seams below the upper rail. These sections can be installed by sliding them between the seam mounting blocks during installation. This design gives flexibility in the design and installation of the snow rail system while also allows for other shapes of rail to be mounted on the attachment blocks for different purposes. This continuous rail adds strength to the system, covers the area between the seams and easily installs giving it many advantages over the prior art.

BRIEF DESCRIPTION OF THE DRAWINGS

FIG. 6 also schematically shows the attachment of other attachments or devices "D" (not shown) to the assembly.

DETAILED DESCRIPTION

Figure 1:
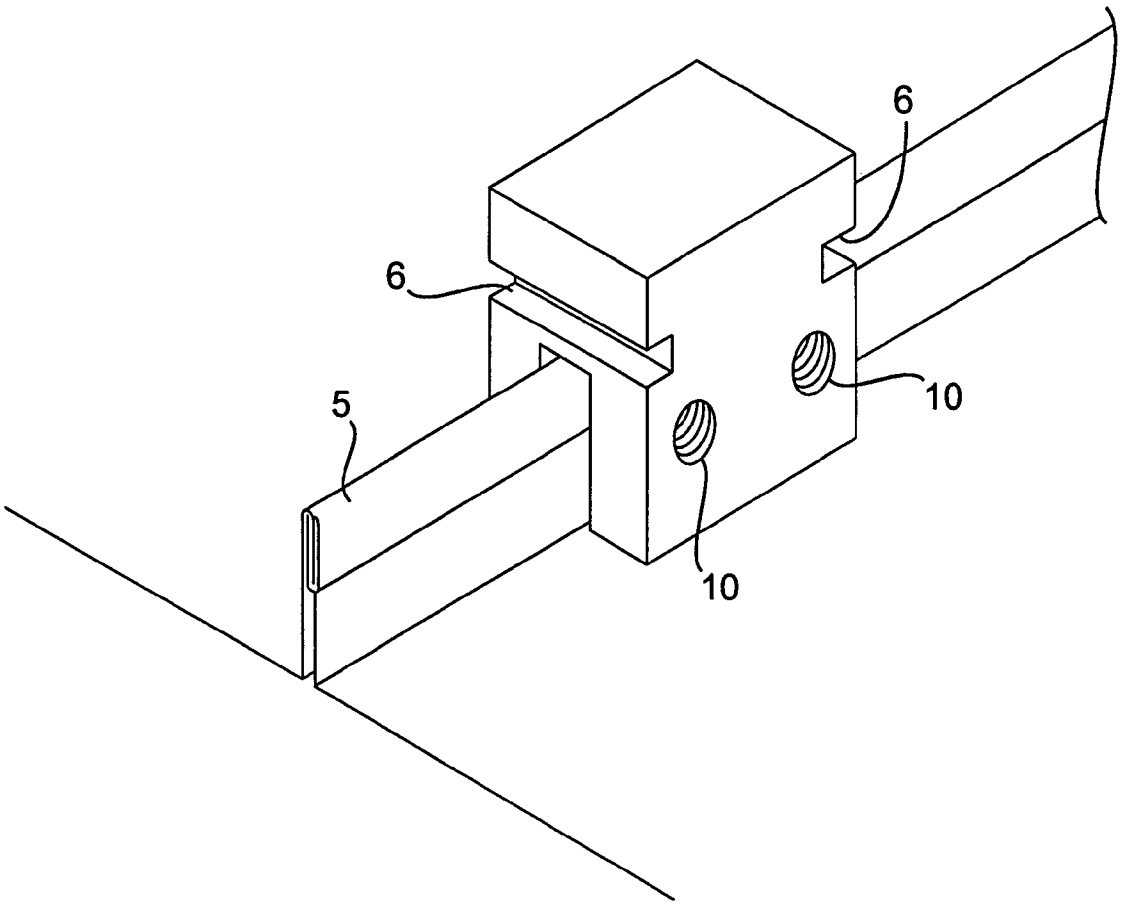
FIG. 1 is a perspective view of the mounting block shown on a raised roof seam, showing the orientation of the seam to the accessory mounting block slots or linear indentations.
Figure 6:
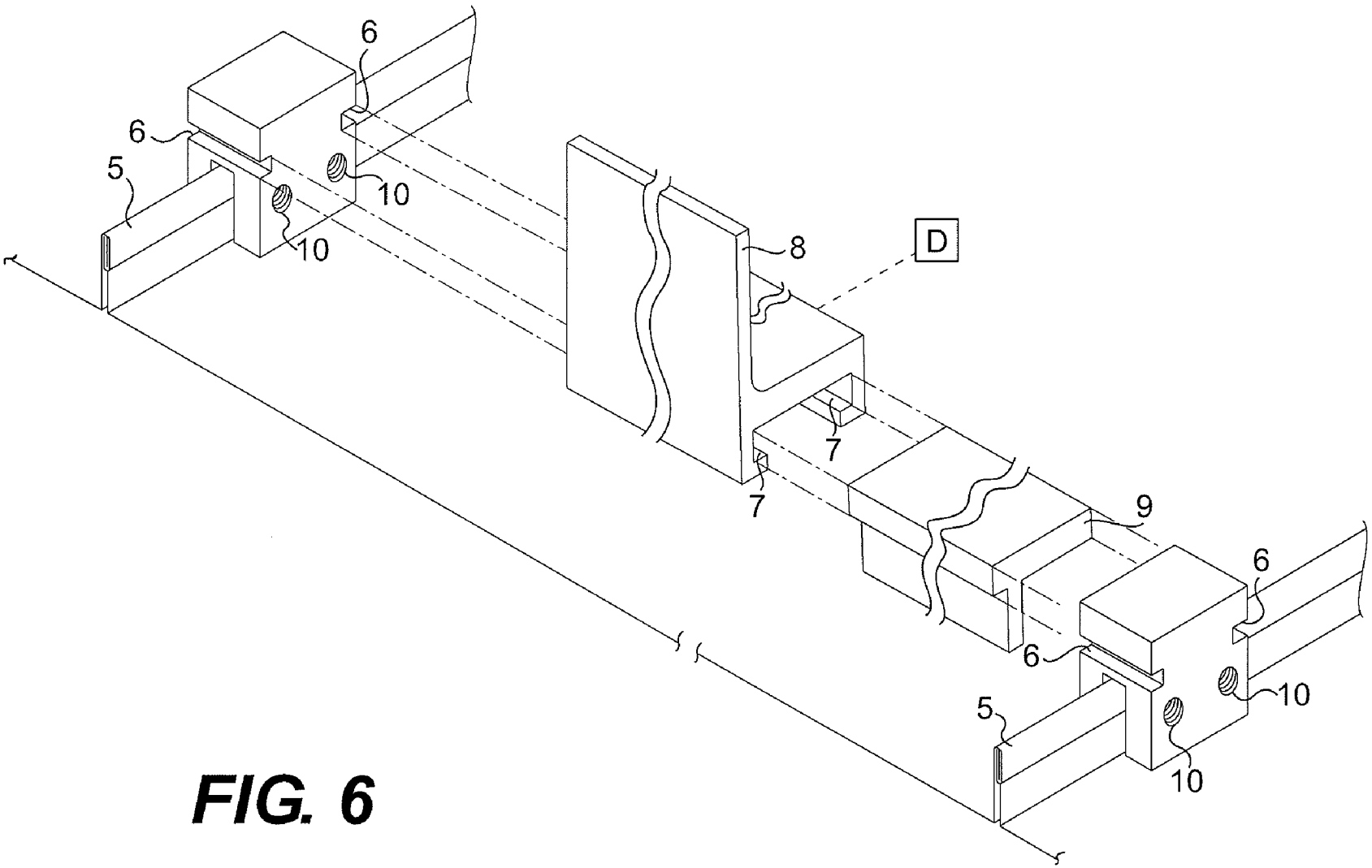
FIG. 6 is an exploded view of two mounting brackets attached to raised roof seams with the snow flag spanning the distance between the brackets.

Referring now to FIG. 1, it is a perspective view of the mounting block 1 in the installed position with slot 3 installed over the metal roof raised seam 5. As illustrated in FIG. 6, the system is composed of three main components, the mounting block 1 , the top snow rail 8 and the bottom rail or snow flag 9. Mounting block 1 contains slots or linear depressions 6 running the length of the mounting block 1 perpendicular to the raised seam 5 and mounting slots 3 and 4.

The mounting slots 3 and 4 can be produced in a variety if linear shapes to fit and function on various metal seam profiles. The two threaded holes 10 can be on one side of mounting block 1 or opposing each other on both sides of mounting block 1 depending on the seam application. Threaded holes for fasteners 10 are generally used with fasteners such as set screws made of stainless steel and are tightened using an Allen or hex type fastener to attach mounting block 1 to raised seam 5. Screws can be opposing, have depressions for screws to force seam material into, or have noses of any shape.

Figure 2:
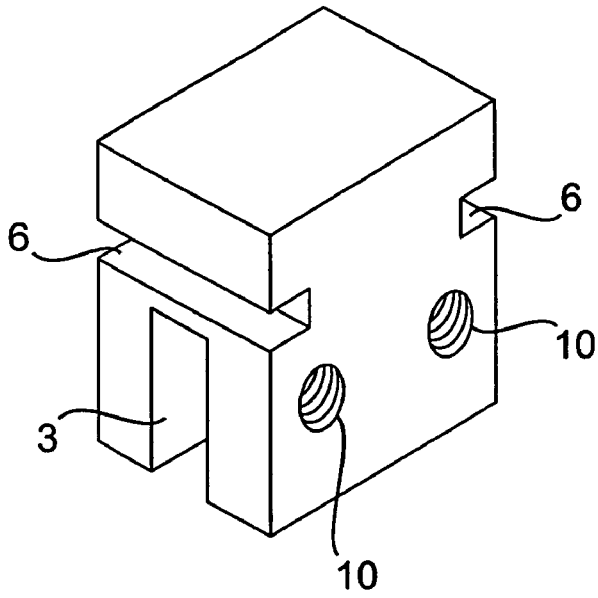
FIG. 2 is a perspective drawing of the mounting block showing the mounting slots or groove and the set screw holes for affixing to the raised seam.
Figure 3:
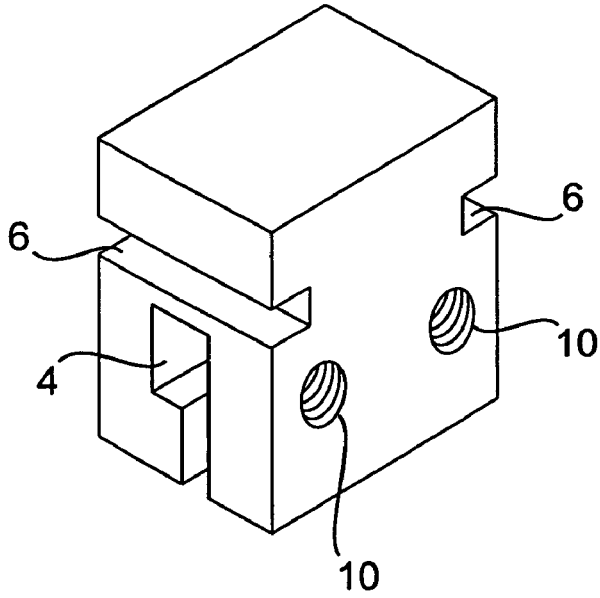
FIG. 3 is a perspective drawing of the mounting block showing a variation of the seam mounting slot. The mounting slot can be configured in different shapes for different roof seam profiles.

FIGS. 2 and 3 illustrate possible shapes for the opening slot 3 and 4. Since there are many different raised seam shapes, the shape of the slot 3 and 4 will be determined by the shape of the profile to which it will be attached. FIGS. 2 and 3 are substantially the same with regard to everything with the exception of the mounting slots 3 and 4. The mounting screw holes 10 and the top snow rail mounting groove remain similar in dimensions.

Figure 4:
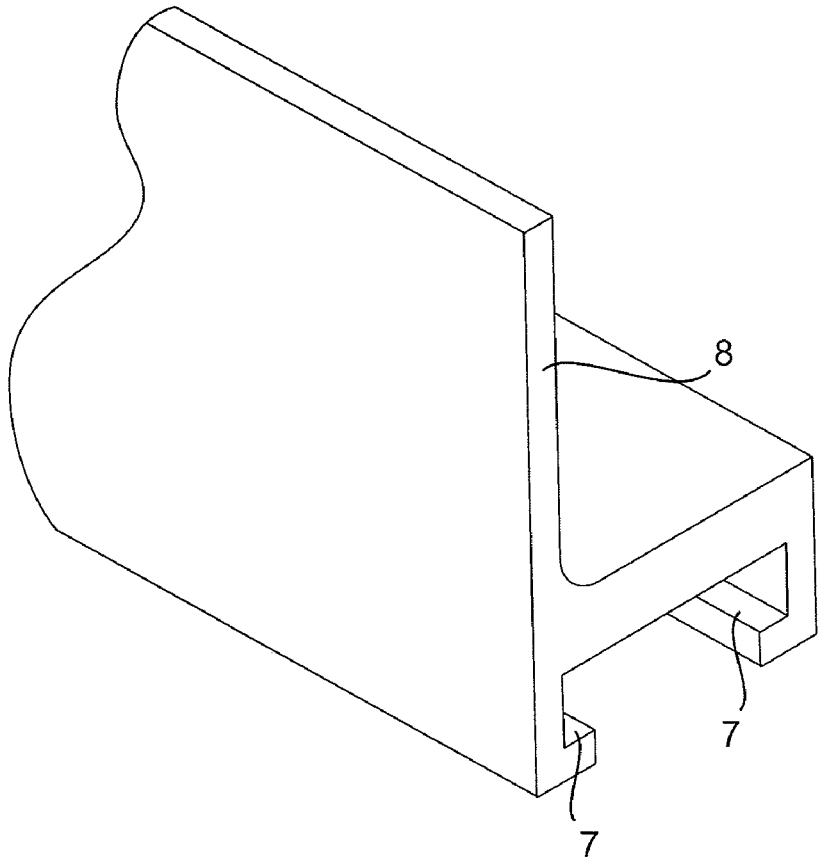
FIG. 4 is a drawing of top rail or snow rail which contains linear indentations which match the shape of the mounting block slots and slide together affixing the top rail to the two or more mounting blocks.

FIG. 4 illustrates the top snow rail 8 with slot 7 for attachment over groove 6 in mounting block 1. Top snow rail 8 will connect two or any number of mounting blocks 1 affixed to any number of parallel raised seams. When installed, the top snow rail portion 8 extends horizontally across the roof perpendicular to the raised seams.

Figure 5:
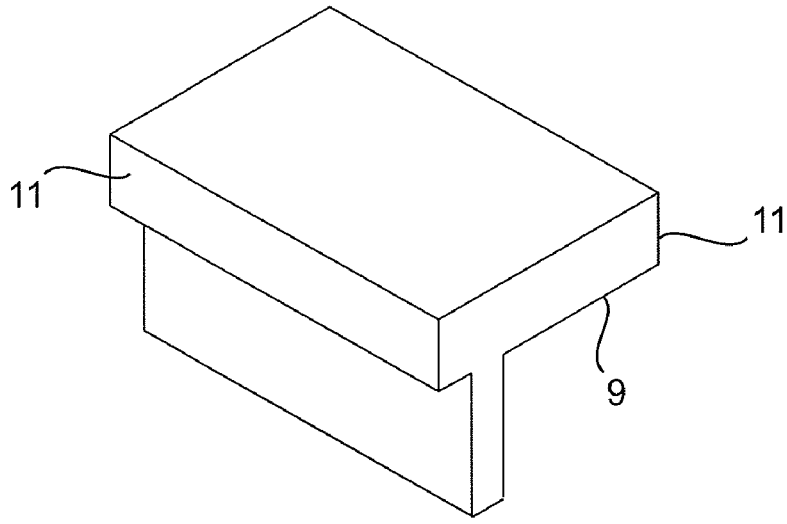
FIG. 5 is a drawing of the bottom rail or snow flag showing the downward extending continuous flag portion that extends between and below the raised seams, while installed by having flanges or extensions on the top surface that fit into the bottom of the top rail slots holding it firmly.

FIG. 5 is a perspective drawing of the bottom rail or snow flag 9. The snow flag 9 performs a number of functions when installed with the top snow rail 8. It is designed to extend below and between the raised seams 5 of a metal roof. Many prior art designs do not extend below the seam height 5 due to the attachment design.

Snow flag 9 is constructed with a horizontal surface across the top of the length of the piece with the outward edges 11 being the same thickness on each side. The thickness and dimensions of snow flag 9 is designed to slide into the groove 7 of top snow rail 8.

While top snow rail 8 can be continuous, thereby spanning more than one raised seam 5, bottom snow flag 9 is designed to be installed in sections between raised seams 5, thereby providing for snow protection below the raised seams 5. Snow flag 9, when installed in conjunction with top snow bar 8, will add strength to the system. When installed, snow flag's 9 top flanges 11 will slide into grooves 7 defined in top snow rail 8. This will anchor the bottom snow flag 9 and add strength to the entire assembly. This will give additional strength to top snow rail 8 for additional snow protection or use as a mounting plate for other roof attachments (e.g., signs, antennae, scaffald).

As best seen in FIG. 6, the mounting block is provided with grooves 6 on its end surfaces. The grooves 6 form a "T"-shaped cross section above the uppermost part of seam-receiving groove 3. Also, as seen in FIG. 6, the top snow rail 8 defines a longitudinal groove 7 that has a "C"-shaped cross section that can be slid over the T-shaped cross section of the mounting block and the upper T-shaped cross section of snow flag element 9.

It can be appreciated from the foregoing description and various embodiments provided that numerous changes or modifications may be made without departing from the spirit or the scope of the invention as defined by the following claims. Although certain preferred embodiments are presented for the purpose of describing the present invention, other species or deviations from the specific embodiments of the invention are to be considered within he scope of the invention.

I claim:

1. A snow brake system for metal roofs with parallel raised metal seams, said system having:

a first mounting block attached to a first raised metal seam, a second mounting block attached to a second raised metal seam located in a spaced relationship to said first seam, a snow rail with one portion connected to said first mounting block and another portion connected to said second mounting block, the improvement wherein:

said first and second mounting blocks comprise:

a base with bottom and top surfaces, the base having a longitudinally extending body with first and second longitudinal end surfaces, a seam-receiving groove extending upward from the bottom surface toward the top surface and terminating at a location spaced from said top surface, said groove extending through the first and second end surfaces, said groove receiving a respective raised metal seam, said groove dividing said base into first and second opposite side portions connected at the top, said first side portion having at least one hole extending transversely through said first side portion for receiving a set screw, said second side portion being shaped to interlock with said raised metal seam to secure said mounting block to said raised metal seam when said set screw is tightened against said seam, said first and second longitudinal end surfaces defining respective grooves, said grooves being positioned perpendicular to said seam receiving groove and positioned above the top of said raised seam, and said snow rail further comprises a longitudinal groove that is configured to interlock with said grooves on said first and second end surfaces of said base to connect said snow rail to said first and second mounting blocks.

2. The snow brake system of claim 1, wherein said grooves in said first and second end surfaces define a T-shaped cross section in said base when viewed along said longitudinal axis.

3. The snow brake system of claim 1, wherein said longitudinal groove on said snow rail defines a C-shaped cross-section in said snow rail when viewed along said longitudinal direction.

4. The snow brake system of claim 3, wherein said T-shaped cross section in said base is interlocked with said C-shaped cross section in said snow rail.

5. The snow brake system of claim 1, wherein a snow flag element is mounted on a portion of said snow rail, said snow flag extending below the top of and between adjacent raised metal seams.

6. The snow brake system of claim 5, wherein said snow flag has a T-shaped cross section when viewed along its longitudinal axis, and said T-shaped cross section is interlocked with a C-shaped cross section in said snow rail.

7. The snow brake system of claim 4 or 5 wherein said snow rail and said snow flag are made of extruded metal.

8. The snow brake system of claims 1 or 3 wherein said snow rail has a generally L-shaped cross section and the leg of the L defines a C-shaped cross section when said snow rail is viewed along said longitudinal direction.

9. The snow brake system of claim 6, wherein the vertical portion of the T-shaped cross section of said snow flag extends downwardly from the bottom of said snow rail and said snow flag has a length that substantially extends along the entire distance between adjacent raised metal seams.

10. The snow brake system of claim 1, wherein said system has a snow rail of a length to extend across many raised metal seams in said metal roof.

11. A system for mounting a snow brake or other devices on metal roofs having parallel raised metal seams, said system having:

a first mounting block attached to a first raised metal seam, a second mounting block attached to a second raised metal seam located in a spaced relationship to said first seam, a rail with one portion connected to said first mounting block and another portion connected to said second mounting block, the improvement wherein:

said first and second mounting blocks comprise:

a base with bottom and top surfaces, the base having a longitudinally extending body with first and second longitudinal end surfaces, a seam-receiving groove extending upward from the bottom surface toward the top surface and terminating at a location spaced from said top surface, said groove extending through the first and second end surfaces, said groove receiving a respective raised metal seam, said groove dividing said base into first and second opposite side portions connected at the top, said first side portion having at least one hole extending transversely through said first side portion for receiving a set screw, said second side portion being shaped to interlock with said raised metal seam to secure said mounting block to said raised metal seam when said set screw is tightened against said seam, said first and second longitudinal end surfaces defining respective groves, said grooves being positioned perpendicular to said seam receiving groove and positioned above the top of said raised seam, said rail further comprises a longitudinal groove that is configured to interlock with said grooves on said first and second end surfaces of said base to connect said rail to said first and second mounting blocks, and means connected to said system for mounting other devices.

12. The method of assembling the snow brake system defined in claim 1, comprising the steps of securing a plurality of mounting blocks to respective raised metal seams of said metal roof, said blocks being aligned along a common axis that runs perpendicular to said raised seams, sliding the longitudinal groove of said snow rail onto the top of a first mounting block whereby said groove interlocks with said grooves on said first mounting block, and further sliding said snow rail onto the top of additional mounting blocks until said snow rail is interconnected to said plurality of mounting blocks.

13. The method of assembling the snow brake system defined in claim 5, comprising the steps of:

a. securing a plurality of mounting blocks to respective raised metal seams of said metal roof, said blocks being aligned along a common axis that runs perpendicular to said raised seams, b. sliding the longitudinal groove of said snow rail onto the top of a first mounting block whereby said groove interlocks with said grooves in said first mounting block, c. sliding the longitudinal groove of said snow rail onto a portion of a snow flag which is positioned to extend between said first mounting block and a second mounting block, d. thereafter sliding said snow rail onto the top of said adjacent mounting block, and thereafter repeating steps c. and d. for additional mounting blocks, whereby the assembly includes a plurality of mounting blocks, a plurality of snow flags and said snow rail.

* * * * *